US006199477B1

(12) United States Patent
Brendel et al.

(10) Patent No.: US 6,199,477 B1
(45) Date of Patent: Mar. 13, 2001

(54) CALENDER FOR TREATMENT OF A PRODUCT WEB

(75) Inventors: Bernhard Brendel; Peter Svenka, both of Grefrath (DE)

(73) Assignee: Edward Kuster Maschinenfabrik GmbH Co. KG, Krefeld (DE)

( * ) Notice: Subject to any disclaimer, the term of this patent is extended or adjusted under 35 U.S.C. 154(b) by 0 days.

(21) Appl. No.: 09/306,652

(22) Filed: May 6, 1999

(30) Foreign Application Priority Data

May 6, 1998 (DE) ..... 198 20 087

(51) Int. Cl.[7] ..... B30B 3/04

(52) U.S. Cl. ..... 100/162 R; 100/161; 100/168; 100/173

(58) Field of Search ..... 100/162 R, 163 R, 100/163 A, 161, 173, 167, 168

(56) References Cited

U.S. PATENT DOCUMENTS 4,890,551 * 1/1990 Dahl et al. ..... 100/163 A
4,924,772 * 5/1990 Schlunke et al. ..... 100/163 R
5,038,678 * 8/1991 Honkala et al. ..... 100/163 R
5,231,924 * 8/1993 Schneid ..... 100/163 A
5,662,037 * 9/1997 Van Hagg ..... 100/163 A
5,673,617 * 10/1997 Linder ..... 100/163 A
5,988,055 * 11/1999 Cramer ..... 100/163 A

* cited by examiner

*Primary Examiner*—Peter Vo
*Assistant Examiner*—Louis K. Huynh
(74) *Attorney, Agent, or Firm*—Townsend and Townsend and Crew

(57) ABSTRACT

The invention relates to a calender for treatment of a product web, having at least one roll stack comprising rolls arranged in a calender frame, the ends of which rolls are guided in roll mountings, which can be fastened to the calender frame by means of brackets, and having guiding means associated with the rolls for guiding a product web through nips formed between the individual rolls. For a rapid change-over with respect to the nature and intensity of the treatment of a product web in a calender, the brackets are in the form of modules, which support the rolls and are capable of being fastened individually to the calender frame and which have identical connecting devices for grouping, as desired, on the calender frame.

9 Claims, 5 Drawing Sheets

CALENDER FOR TREATMENT OF A PRODUCT WEB

CROSS REFERENCE TO RELATED APPLICATIONS

Not applicable.

STATEMENT REGARDING FEDERALLY SPONSORED RESEARCH AND DEVELOPMENT

Not applicable.

BACKGROUND OF THE INVENTION

1. Field of the Invention

The invention relates to a calender for treatment of a product web, according to the preamble of claim 1.

2. Description of Related Art

Rapid development and the requirement for new qualities of product web, especially new paper qualities, having specific properties in terms of use and function call for calender set-ups that differ with respect to the number of rolls and the nature of the rolls, in order to achieve the required web properties. The costs involved in a calender set-up have increased hugely, by virtue of the high production capacities, because of the need for extensive control and regulation devices, which result in high investment costs.

The object of the invention is therefore to provide a calender for treatment of a product web, according to the preamble of claim 1, which allows a rapid change-over with respect to the nature and intensity of the treatment of a product web in a calender.

BRIEF SUMMARY OF THE INVENTION

The object is met by the features of claim 1.

A calender is accordingly provided, the configuration of which is capable of being adapted to a specific treatment of a product web. The total number of rolls and nips, both as a whole and sub-divided into individual roll stacks or calendering units, can be so arranged that, by virtue of the selected configuration of the calender, the required treatment on each side of the product web will reliably be achieved. A high degree of flexibility in configuration and adaptation is achieved without additional new investment costs and time-consuming conversions and rearrangements in the configuration of the calender and, in particular, without qualitatively or quantitatively curtailing or compromising the high technical standard. Furthermore, major interruptions to production or production downtime lasting for relatively long periods, which would involve high costs, are avoided. The set-up of the calender can be individually adapted to the desired quality of product web as well as to the nature of the product web.

As a result of the fact that the calender rolls are positioned on the calender frame in modular fashion, rigid and yielding rolls and also deflection controlled rolls can be combined to form a roll set-up in accordance with specification. It is possible to carry out rapid regrouping and rearrangement to form different roll configurations, resulting in a flexible calendering configuration.

Furthermore, as a result of the fact that the holder assemblies for deflection-controllable rolls, on the one hand, and for intermediate rolls, on the other hand, have identically constructed connecting devices, it is possible for short conversion times to be achieved.

For the modules, defined positions can be provided on the calender frame so that the modules are capable of being rapidly re-positioned and of being quickly and reliably connected to, and removed from, the calender frame.

The modules are advantageously in the form of holder assemblies having a carriage guide for the purpose of accommodation and for fastening to the calender frame. For the purpose of accommodating the roll mountings, those holder assemblies for deflection-controllable rolls can be in the form of rigid holder plates. In the case of intermediate rolls, the holder assembly makes it possible for a loading or load-relieving jack to bear against the holder assembly directly.

To adapt the guiding means to the calender set-up in question, the guiding means can be arranged to be displaceable. The externally located guiding means are preferably held on a separate frame.

Further developments of the invention can be found in the following description and in the dependent claims.

BRIEF DESCRIPTION OF THE DRAWINGS

The invention will be described hereinafter in greater detail with reference to embodiments shown in the attached drawings.

DETAILED DESCRIPTION OF THE INVENTION

Figure 1:
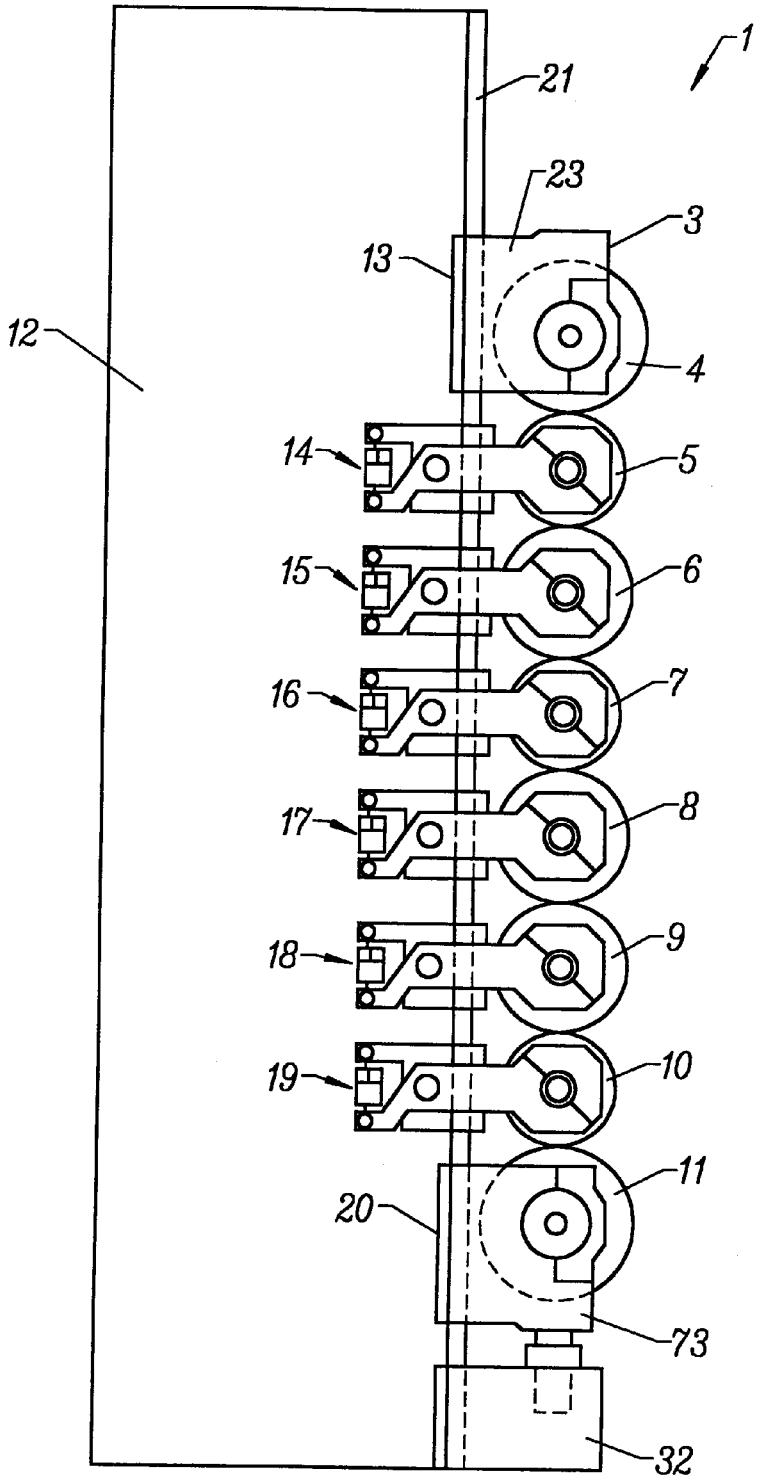
FIG. 1 is a diagrammatic side view of a first embodiment of the invention.

FIG. 1 shows a calender 1 for treatment of a product web 2, especially a paper web or a textile web, having at least one roll stack 3 comprising rolls 4 to 11, which in this instance are arranged above one another and form a vertical roll stack 3. Between the individual rolls 4 to 11 nips are formed, through which a product web (not shown) passes. The rolls 4 to 11 can be in the form of rigid, resilient or deflection-controllable rolls as desired. The number of rolls can be selected in dependence on the type and intensity of treatment of a product web. The upper roll 4 and the lower roll 11 are also preferably in the form of deflection-controllable rolls. The rolls 5 to 10 located between them form so-called intermediate rolls.

The rolls 4 to 11 are arranged on a calender frame 12 by means of respective brackets 13 to 20. The brackets 13 to 20 are constructed as independent assemblies in the form of modules, which have identically constructed connecting devices 22 (FIG. 2, FIG. 3), by means of which the modules can be fastened to the calender frame 12. Irrespective of whether the brackets 13 to 20 are designed for accommodating a rigid, resilient or deflection-controllable roll, the connecting device 22 present in each case for fastening to the calender frame 12 is identical. It is therefore possible for the modules to be grouped as desired on the calender frame 12 for the purpose of constructing various roll arrangements.

For that purpose, the calender frame 12 has a guide bar or slide bar 21, on which the brackets 13 to 20 are held, and can be secured, by means of their connecting devices 22.

The guide bar or slide bar 21 of the calender frame 12 preferably extends along a longitudinal side of the calender frame 12 for the arrangement of selectable roll configurations along that longitudinal side.

The brackets 13 to 20 each have, as connecting device 22, a carriage-like guide (see FIG. 3), which can engage, in the shape of a U, around the guide bar 21 of the calender frame. The connecting devices 22 form part of the modularly configured brackets 13 to 20. The connecting devices 22 therefore allow the brackets 13 to 20 to be attached and secured on the calender frame 12 irrespective of the kind of roll that is being held and irrespective of its position along the calender frame 12.

Figure 2:
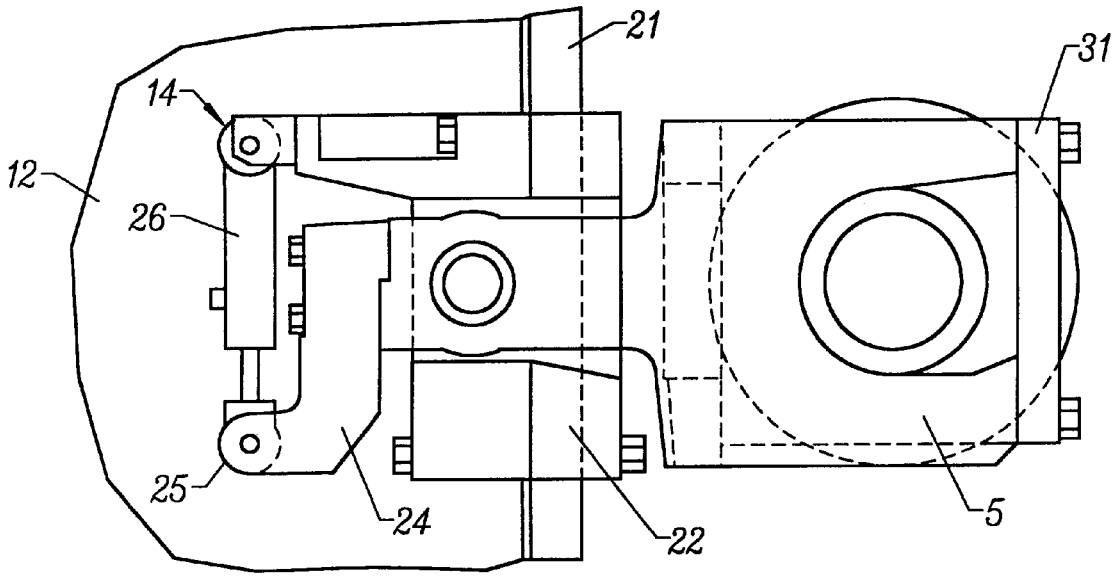
FIG. 2 is a diagrammatic side view of a bracket according to FIG. 1 for an intermediate roll, which bracket is in the form of a module.
Figure 3:
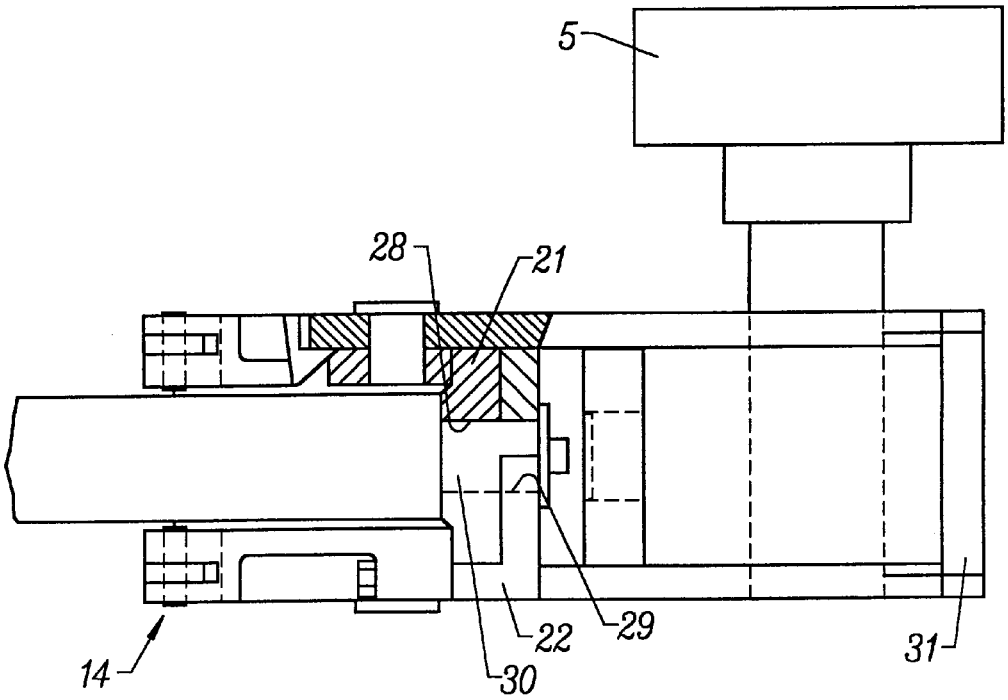
FIG. 3 is a plan view, in partial section, of the module according to FIG. 2.

The modular brackets 13 to 20 for the deflection-controllable rolls 4, 11 preferably have, for holding those rolls, rigid holder plates 23, 73, in which the rolls 4, 11 are mounted by means of roll mountings. The rigid holder plates 23, 73 are in each case fastened to a connecting device 22. For the intermediate rolls 5 to 10, the modular brackets are constructed in a different manner. As shown in FIG. 2 and FIG. 3, a pivot arm 24 is pivotably mounted on the connecting device 22. The pivot arm 24 accommodates an end of an intermediate roll 5 to 10 by means of a roll mounting. A free end 25 of the pivot arm 24 is acted on by a loading or load-relieving jack 26, which bears against the brackets 14 to 19 for the intermediate roll in question. The loading or load-relieving jack 26 especially bears against the connecting device 22, by means of which the modules are fastened to the calender frame 12.

Figure 5:
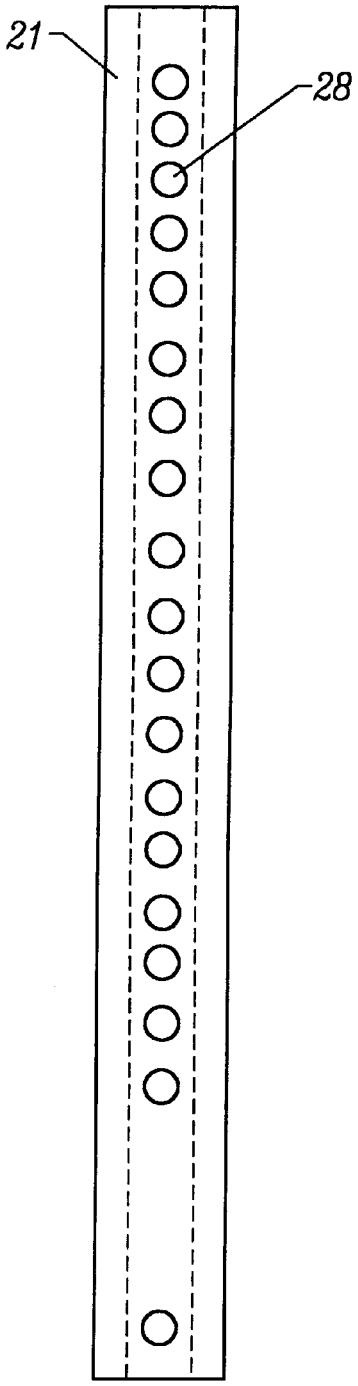
FIG. 5 shows, in diagrammatic form, a slide bar on the calender for arrangement of the modules.

The modular brackets 14 to 19 can be fastened to the guide bar 21 of the calender frame 12 by means of lock-in connections. For that purpose, the guide bar 21 of the calender frame 12 has locking holes 28 (see FIG. 5), with which there are associated locking holes 29 in the connecting devices 22 of the respective brackets 14 to 19 (see FIG. 3). By means of a bolt 30, which can be inserted through the holes 28 and 29 and fixed there, it is possible for the modules 14 to 19 of the intermediate rolls 5 to 10 to be fastened at selectable locking locations of the locking hole 28.

The modular brackets 13, 20 for the deflection-controllable rolls 4 and 11 can be constructed in corresponding manner with locking holes for the entry of a locking bolt.

Furthermore, FIG. 2 shows that, for accommodating an intermediate roll 5 to 10, the pivot arm 24 can have a roll mounting closure 31, which can be detached for inserting or removing a roll.

Figure 4:
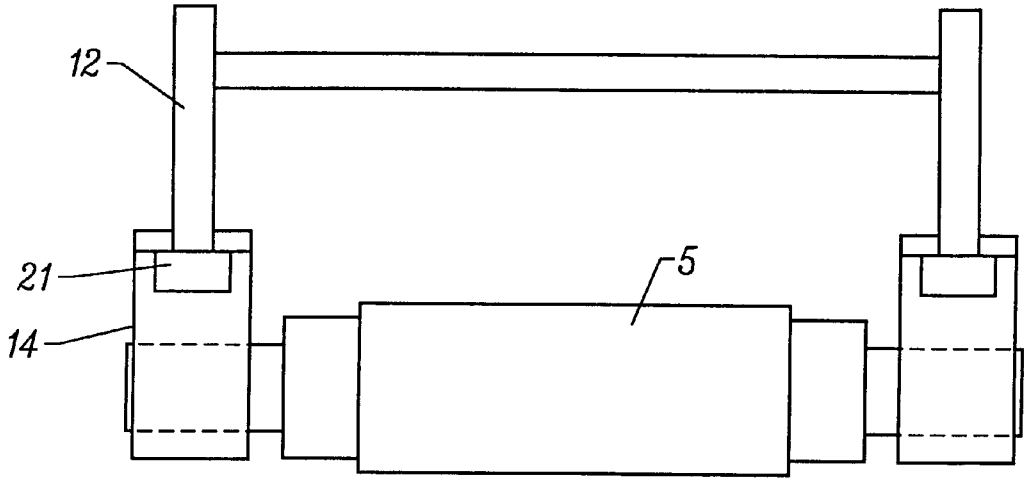
FIG. 4 is a diagrammatic plan view of a module unit together with a calender roll.

The modular brackets 13 to 20 described above are used for the purpose of accommodating a respective end of a roll 4 to 11. For fastening both ends of the rolls 4 to 11 to a calender frame 12, there are provided module units each comprising two holder assemblies located opposite one another, as shown in diagrammatic form in FIG. 4. The construction of the holder assemblies located opposite one another corresponds to that of the modules 13 to 20 described above, except that the construction is mirror-symmetrically transposed.

The first embodiment of a calender according to FIG. 1 shows a roll configuration comprising a deflection-controllable upper roll 4, a deflection-controllable lower roll 11 and intermediate rolls 5 to 10. Those rolls together form a roll stack 3, which can be acted on from below by means of a hydraulic cylinder 32.

As already mentioned at the beginning, it is possible, using the modular brackets 13 to 20, to form any desired roll configuration on the calender frame 12.

Figure 6:
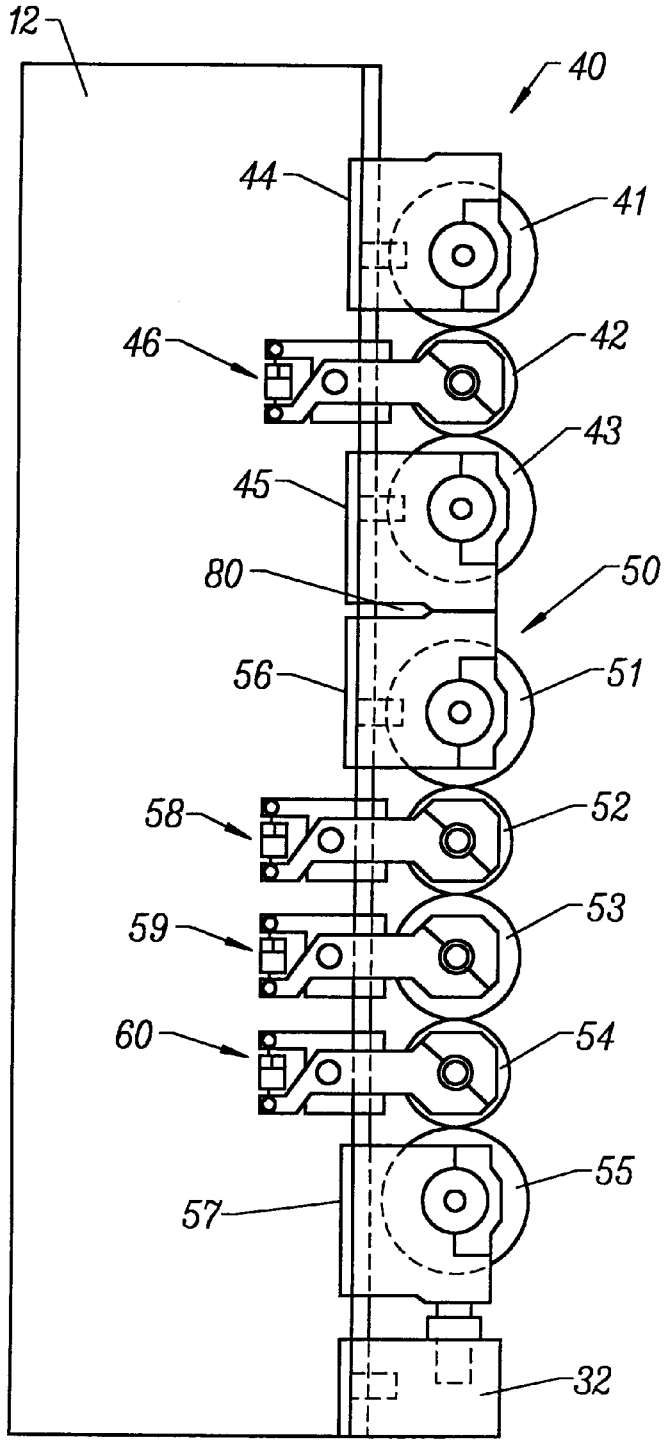
FIG. 6 shows a second embodiment of a calender having a second roll configuration.
Figure 7:
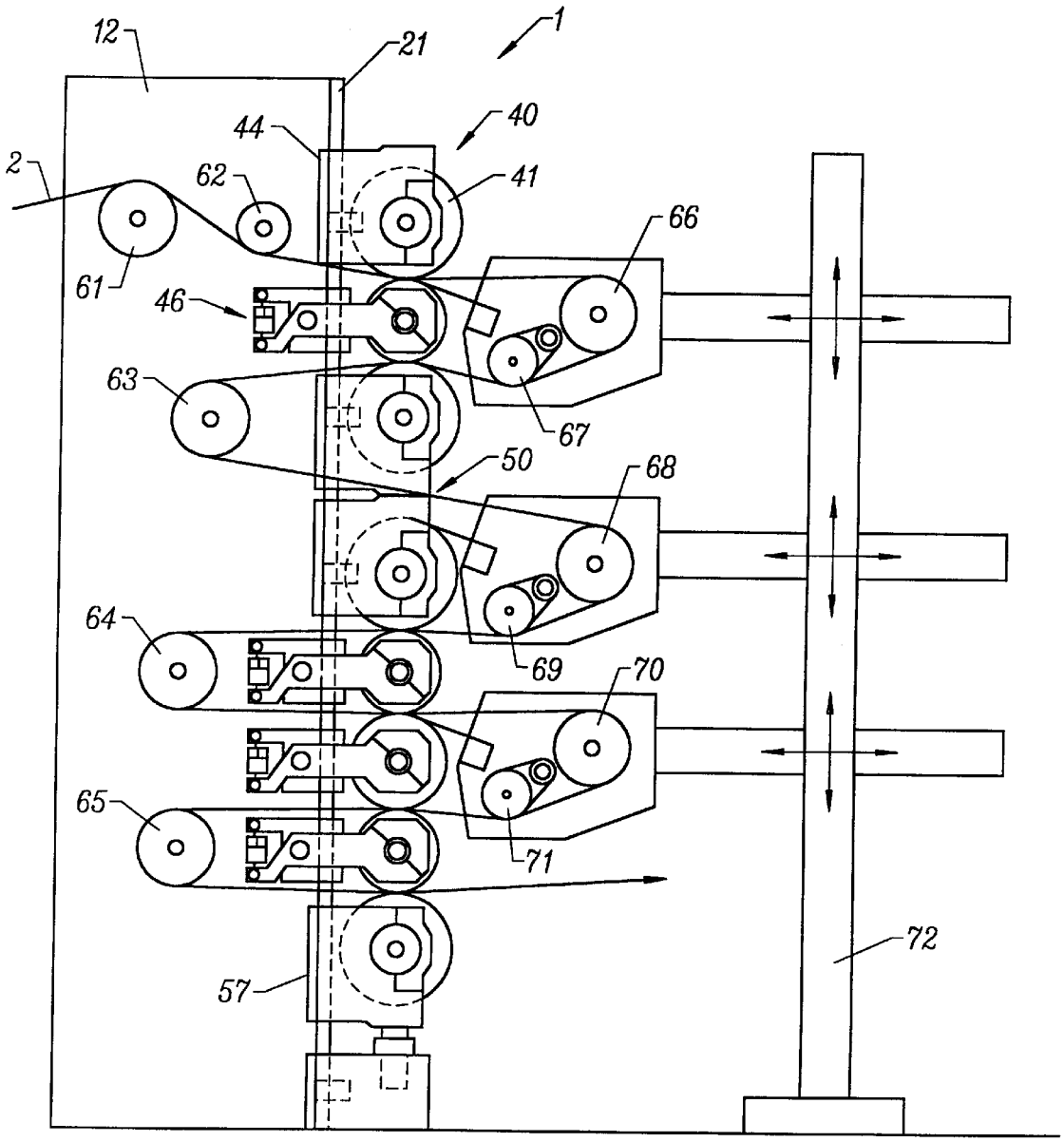
FIG. 7 shows the roll configuration according to FIG. 6 in combination with guiding means and a product web.

FIG. 6 shows, by way of example, a further roll configuration having two roll stacks. A first roll stack 40 comprises a deflection-controllable upper roll 41, an intermediate roll 42 and a deflection-controllable lower roll 43. A second roll stack 50 follows on with a deflection-controllable upper roll 51. There then follow three intermediate rolls 52, 53, 54 and a deflection-controllable lower roll 55. The two roll stacks 40 and 50 are connected via an open gap 80 (change-over gap), through which a product web 2 passes, as shown in FIG. 7. The two separate roll stacks 40 and 50 are used for different treatment of the two sides of a product web. The deflection-controllable upper roll 41 and the deflection-controllable lower roll 43 are mounted in modular brackets 44, 45, which are constructed in corresponding manner to the modular brackets 13 and 20 according to FIG. 1. The intermediate roll 42 is mounted in a modular bracket 46, which is constructed in corresponding manner to the modular brackets 14 to 19 of FIG. 1.

In the second roll stack 50, the deflection-controllable upper roll 51 is mounted in a bracket 56, which in turn corresponds to the modular brackets 13 to 20 of FIG. 1. The same is true for the deflection-controllable lower roll 55, the modular bracket 57 of which is constructed in corresponding manner to the modular bracket 20 according to FIG. 1. The intermediate rolls 52, 53 and 54 have modular brackets 58, 59, 60, which correspond to the modular brackets 14 to 19 according to FIG. 1.

FIG. 7 shows the embodiment according to FIG. 6 with a product web 2, which passes through the roll stacks 40, 50 and the change-over gap 80, also in association with internal guiding means 61, 62, 63, 64 and 65 and external guiding means 66 to 71 for the purpose of guiding the product web 2. Those internally and externally located guiding means 61 to 71 are preferably arranged to be displaceable in order to be capable of being oriented with respect to the roll configuration in question. The guiding means are preferably turn-around and stretcher rolls, which enable the product web 2 to be guided with respect to the nips formed between every two rolls. Furthermore, the externally located guiding means 66 to 71 are preferably mounted on a frame 72 so as to be movable between an operating position and a non-operating position.

What is claimed is:

1. Calender for treatment of a product web, having at least one roll stack comprising hard, soft and deflection controlled rolls arranged in a calender frame, the ends of said rolls are guided in roll mountings, said mounting being fastened to the calender frame by means of brackets, and having guiding means, associated with the rolls, for guiding a product web through nips formed between the individual rolls, wherein the brackets for all rolls of the roll stack are constricted as independent assemblies in the form of modules, said modules supporting, the rolls and being capable of being fastened to the calender frame and having identically constructed detachable connecting devices for individually holding and securing said modules in desired groups of various rolls on the calender frame by means of said detachable connecting devices engaging said calender frame so as to enable each roll to be mounted and dismounted on the frame independently of the others.

2. Calender according to claim 1 wherein the connecting devices comprise U-shaped guides, said guides being arranged to be mounted on a guide rail of the calender frame and secured thereto.

3. Calender according to claim 1 or claim 2, wherein the calender frame has a guide rail having a lock-in connection for fastening the modules to the calender frame in a spatially predeterminable manner.

4. Calender according to claim 3, wherein the modules for a deflection-controllable roll are in the form of a holder assembly having rigid holder plates for accommodating a respective roll mounting.

5. Calender according to claim 3, wherein the modules for an intermediate roll are in the form of holder assemblies, each holder assembly having a pivot arm accommodating a roll mounting, said pivot arm having a free end opposed from the roll mounting, the free end of said pivot arm being acted on by a loading or load-relieving jack, said jack bearing against the module.

6. Calender according to claim 5, wherein the loading or load-relieving jack bears against the connecting device of the respective module of the intermediate roll.

7. Calender according to claim 5, wherein the loading or load-relieving jack is formed by a hydraulic cylinder.

8. Calender according to claim 1 or 2, wherein each of the two ends of a roll, is supported by a module and the two modules of a roll are fastened to the calender frame and are brought into line with one another for horizontal orientation of a roll.

9. Calender according to claim 1 or 2, wherein the guiding means are arranged to be displaceable in accordance with the roll stack set-up.

* * * * *

UNITED STATES PATENT AND TRADEMARK OFFICE

CERTIFICATE OF CORRECTION

PATENT NO. : 6,199,477 B1
DATED : March 13, 2001
INVENTOR(S) : Brendel, Bernhard et al.

It is certified that error appears in the above-identified patent and that said Letters Patent is hereby corrected as shown below:

Column 1,
Line 15, after 2. Description of Related Art, please insert -- Not applicable --.

Column 4,
Line 56, please change constricted to -- constructed --

Signed and Sealed this

Twelfth Day of February, 2002

*Attest:*

*Attesting Officer*

JAMES E. ROGAN
*Director of the United States Patent and Trademark Office*